US008387338B1

(12) United States Patent
Smith

(10) Patent No.: US 8,387,338 B1
(45) Date of Patent: Mar. 5, 2013

(54) METHOD OF MAKING CONCRETE FACADE LOGS AND SIDING FOR A BUILDING

(76) Inventor: Walter Smith, Corbin, KY (US)

( * ) Notice: Subject to any disclaimer, the term of this patent is extended or adjusted under 35 U.S.C. 154(b) by 113 days.

(21) Appl. No.: 13/068,710

(22) Filed: May 18, 2011

(51) Int. Cl.
*E04B 1/10* (2006.01)

(52) U.S. Cl. ..... 52/745.09; 52/233; 52/745.1; 264/220

(58) Field of Classification Search ..... 52/233, 52/745.05, 745.09, 745.1, 747.1; 264/219, 264/220, 224
See application file for complete search history.

(56) References Cited

U.S. PATENT DOCUMENTS 2,045,482 A * 6/1936 Maier ..... 52/316
4,288,954 A 9/1981 O'Donnell
4,433,519 A * 2/1984 Jenkins ..... 52/233
5,181,358 A * 1/1993 Mead ..... 52/233
5,271,888 A * 12/1993 Sinsley ..... 264/87
5,735,099 A 4/1998 Anderson
6,851,233 B2 2/2005 Morgenstern
7,223,095 B1 5/2007 Corry
7,444,786 B2 11/2008 Morgenstern
2004/0187411 A1 9/2004 Clegg
2007/0204538 A1 9/2007 Miller et al.

OTHER PUBLICATIONS

EverLog Siding website. Published by Everlog Systems, USA (Apr. 2011).

* cited by examiner

*Primary Examiner* — Basil Katcheves
(74) *Attorney, Agent, or Firm* — Kenneth F. Pearce

(57) ABSTRACT

A method of making siding for attachment to a frame of a building. The siding has the appearance of antique hewn wood logs, and the siding includes modular lengthwise sections and corner modular sections of reinforced concrete façade logs.

12 Claims, 6 Drawing Sheets

METHOD OF MAKING CONCRETE FACADE LOGS AND SIDING FOR A BUILDING

BACKGROUND OF THE INVENTION

1. Field of the Invention

In the most general sense, the present method relates to the production of concrete façade logs that can be used for siding of a building. The method produces modular lengthwise sections and modular corner sections of reinforced concrete logs with the aesthetic appeal of antique hewn wood logs. Modular corner sections have casts that are wider than the width of adjacent modular lengthwise sections.

2. Description of the Previous Art

Any discussion of references cited in this Description of the Previous Art merely summarizes the disclosures of the cited references and Applicant makes no admission that any cited reference or portion thereof is relevant prior art. Applicant reserves the right to challenge the accuracy, relevancy and veracity of the cited references.

1) U.S. Pat. No. 4,288,954—O'Donnell enables a simulated log siding. Column 3, lines 18-34, reads, "FIG. 1 illustrates the elements which combine to simulate a true log-wall structure. The natural log simulation is accomplished by applying a skeletal structure of a log wall to the existing frame work of a building. Coatings which are highly impermeable to water, are then applied to simulate the color and texture of natural logs. When the water impermeable coatings have set and cured, the overall appearance is of the building with natural log walls, which logs have characteristic bark color and display the shadowed interior of the bark interstices and the added appearance of a light colored caulking between the logs. The development of the simulated log wall may be carried on completely at the work site or sections of the simulated log covering, of convenient size and handling abilities, may be prefabricated at a facility removed from the work site."

Among other things, O'Donnell does not teach or suggest the use of antique hewn wood logs to form molds for receiving poured concrete or concrete lengthwise modules and concrete corner modules, where the concrete modules are of such size and weight as to eliminate the need of a mechanical lift for moving the concrete modules, where the corner modules are capable of interlocking with each other and include a cast of greater width than the width of the lengthwise modules and where the cured concrete modules reproduce the exterior surfaces of the antique hewn wood logs, including decay associated therewith, used to form the molds.

2) U.S. Pat. No. 5,735,099—Anderson enables log siding. Columns 4, line 65 through Column 5, line 16 read, "The present invention provides an improved log siding for use on the exterior and/or interior of pre-fabricated buildings so as to simulate the outward appearance of a log construction. To do so, the improved log siding of the present invention may be constructed out of wood, plastic, or metal. If a wood construction is desired, the present invention may be manufactured through a single step process whereby a wood planer is used to shape and form a wood plank, referred to as a cant, into the particular embodiments that follow. Similarly, a single step manufacturing process is capable for both plastic or metal construction, whereby the desired shape may be formed by injection molding or bending, respectively. In all cases, the present invention is manufactured to provide a moisture-proof seal between the vertically adjacent log siding members so as to reduce the propensity for moisture to infiltrate into or behind the log siding members to cause swelling, rotting, or cracking with time."

Among other things, Anderson does not teach or suggest the use of antique hewn wood logs to form molds for receiving poured concrete or concrete lengthwise modules and concrete corner modules, where the concrete modules are of such size and weight as to eliminate the need of a mechanical lift for moving the concrete modules, where the corner modules are capable of interlocking with each other and include a cast of greater width than the width of the lengthwise modules and where the cured concrete modules reproduce the exterior surfaces of the antique hewn wood logs, including the decay associated therewith, used to form the molds.

3) U.S. Pat. No. 6,851,233—Morgenstern enables a cast log structure. Column 15, lines 1 through 21, reads, "The interior and exterior layers of the structural elements can be fabricated from cast concrete material, and can be provided with simulative exposed surfaces. In the illustrated embodiment, the exterior surfaces of the structural elements simulate the appearance of hand-hewn structural logs, including end surfaces 54 (FIG. 1). It is also anticipated that the exterior surfaces could be fabricated to simulate round logs, or any other desired horizontal structural element, and that the simulated log surfaces can be textured and stained to simulate stripped logs or logs with the bark left on. Similarly, the interior surfaces of the structural elements can be fabricated to simulate log surfaces, wood paneling, stone, sheetrock, or any desired texture, and can be stained or painted to any suitable interior finish. The structural elements can be fabricated using rubber molds made from actual timbers, logs, paneling, stones, etc. using rubber molds in a generally known manner. Companies from which such molds are available in other configurations include Symons, Burke, Scofield, and Scott. Electrical and heating conduits 56, 58 can be cast in the wall during fabrication to avoid surface mounting."

Among other things, Morgenstern does not teach or suggest the use of antique hewn wood logs to form molds for receiving poured concrete or concrete lengthwise modules and concrete corner modules, where the concrete modules are of such size and weight as to eliminate the need of a mechanical lift for moving the concrete modules, where the corner modules are capable of interlocking with each other and include a cast of greater width than the width of the lengthwise modules and where the cured concrete modules reproduce the exterior surfaces of the antique hewn wood logs, including the decay associated therewith, used to form the molds.

4) U.S. Pat. No. 7,223,095—Corry enables a composite concrete artificial log. Column 3, lines 3 through 13, read, "An artificial concrete log (1) is cast the body shape includes at least one cut out (2) or (2a) in order to form at least one open cavity the open cavity will provide a secondary air chamber (3, the log (1) is placed on an existing gas log fire for some of the gas flames to travel up producing an inner log burning visual effect at the same time the gas flames will impinge on the front surface of the ceramic fiber pad (6) producing a surface glow (6) and radiant heat simulates a real burning log with flames coming out of the body of the log when used in a gas log fire."

Among other things, Corry does not teach or suggest the use of antique hewn wood logs to form molds for receiving poured concrete or concrete lengthwise modules and concrete corner modules, where the concrete modules are of such size and weight as to eliminate the need of a mechanical lift for moving the concrete modules, where the corner modules are capable of interlocking with each other and include a cast of greater width than the width of the lengthwise modules and where the cured concrete modules reproduce the exterior surfaces of the antique hewn wood logs, including the decay associated therewith, used to form the molds.

5) U.S. Pat. No. 7,444,786—Morgenstern discloses a cast log structure. The '786 patent is a continuation-in-part of U.S. Pat. No. 6,851,233. Thus, among other things, the '786 patent does not teach or suggest the use of antique hewn wood logs to form molds for receiving poured concrete or concrete lengthwise modules and concrete corner modules, where the concrete modules are of such size and weight as to eliminate the need of a mechanical lift for moving the concrete modules, where the corner modules are capable of interlocking with each other and include a cast of greater width than the width of the lengthwise modules and where the cured concrete modules reproduce the exterior surfaces of the antique hewn wood logs, including the decay associated therewith, used to form the molds.

6) US Published Patent Application 20040187411—Clegg a concrete construction log. Paragraphs 19 through 21 read, "[0019] The "logs" are formed by a process wherein a mold configured to form a preformed modular concrete piece is prepared. This mold may be configured to have the appearance of a log, as well as the desired length, circumference, number, and size of apertures as desired by a user. Once the properly dimensioned and sized mold is selected, concrete is poured into the device and allowed to harden. When this concrete has properly cured and hardened, the mold is removed and the "log" is ready for use in building structures.

In some applications, a variety of modifications may be made to this process to achieve a variety of desired end results with regard to the logs that are formed by this process. In some embodiments, an insulating element may be placed within the mold so as to provide a "log" construction element that has increased insulating properties. In other embodiments, a reinforcing structure may be placed within the mold to provide increased structural strength to the element which "logs" which are formed from the device. Once the mold is prepared, it is filled with a concrete composition that is configured to form a hardened matrix having desired structural strength, weathering resistance, and aesthetic qualities. When the concrete composition has sufficiently dried and hardened, the newly formed "log" and the mold are separated. If so desired, the concrete log can then be passed along for additional work such as finishing, painting or sealing.

These pre-cast modular concrete logs provide a variety of advantages over the wooden pieces used in the prior art. These pre-cast modular concrete logs have increased strength due to the inclusion of reinforced concrete. These pre-cast modular concrete building pieces also have the ability to better resist water and weather damage than the wooden logs in the prior art. The preformed modular concrete logs of the present invention are also insulated to better control the flow of heat into and out of a device. These devices can also be preformed of a desired length, and can be configured to have generally uniform characteristics thus allowing these pieces to fit together in a desired orientation to form structures without having to cut the pieces to fit or otherwise prepare the pieces for assembly. Construction with these elements simply involves the placement of these preformed modular concrete devices in the appropriate positions, installing the reinforcing rods, if desired, and grouting the pieces together, if so desired. In some applications, such as the construction of a retaining wall, simply stacking the preformed modular concrete devices may be sufficient to hold some structures in place."

Among other things, Clegg does not teach or suggest the use of antique hewn wood logs to form molds for receiving poured concrete or concrete lengthwise modules and concrete corner modules, where the concrete modules are of such size and weight as to eliminate the need of a mechanical lift for moving the concrete modules, where the corner modules are capable of interlocking with each other and include a cast of greater width than the width of the lengthwise modules and where the cured concrete modules reproduce the exterior surfaces of the antique hewn wood logs, including the decay associated therewith, used to form the molds.

7) US Published Patent Application 20070204538—Miller, et al. discloses a log-cabin type façade. Paragraphs 7, 12 read, [007] The design of the façade according to the invention according to claim 1 is advantageous in that the elongated contoured elements are designed to be identical such that they can be used equally well on an internal wall and on an external wall and have the same attachments both on their right and on their left end. These elongated contoured elements can be used for the production of an internal corner as well as an external corner in internal and external areas. Moreover, the façade according to the invention is advantageous in that the corner-forming elements are also designed to be identical and can be used to form a cross bond on a left or right end of a tree trunk that is to be imitated independent of their arrangement.

According to an advantageous embodiment of the invention the contoured elements or corner-forming elements and the intermittent parts are provided such as to be connectable by means of plug-in connection elements, preferably bolts, in particular made of wood or wooden dowels. This can provide for simple assembly at high stability that is facilitated by simple plugging-in or putting together.

According to a preferred embodiment, the contoured elements are designed to have a semi-circular cross-section that comprises a circular external side imitating a tree trunk and an internal side with recesses serving as an abutment surface. The recesses provided on the internal side can, for example, be W- or V-shaped, triangular-shaped or of a similar shape. They are advantageous in that, provided natural wood is used as contoured element, splitting of the wood during the drying process is prevented. At the same time, utility lines can be inserted into these recesses, for example in order to supply energy to a wall lamp or similar to be attached to the façade. It is self-evident that any other application is also feasible.

According to a further advantageous embodiment of the invention, the contoured elements, the corner-forming elements, and the intermittent parts are provided to be made of wood. For external areas, it is preferred to use the wood of larch trees, Douglas firs. For internal areas or sauna construction, the wood of cedars, northern firs, hemlock firs, pine trees, oak trees or similar. Alternatively, the invention can provided for the use of wood imitations or, for example, plastic contoured elements with laminated wood or other basic structures onto which a laminate or an optical structure corresponding to wood is sprayed, glued or attached by similar means."

Among other things, Miller does not teach or suggest the use of antique hewn wood logs to form molds for receiving poured concrete or concrete lengthwise modules and concrete corner modules, where the concrete modules are of such size and weight as to eliminate the need of a mechanical lift for moving the concrete modules, where the corner modules are capable of interlocking with each other and include a cast of greater width than the width of the lengthwise modules and where the cured concrete modules reproduce the exterior surfaces of the antique hewn wood logs, including the decay associated therewith, used to form the molds.

SUMMARY OF THE INVENTION

The method present method creates a reinforced concrete façade log with the outward aesthetic appeal of an antique hewn wooden log. When attached to the frame of a building, the reinforced concrete façade logs provide a durable and low maintenance siding for a building. In accordance with the current method, the reinforced concrete façade logs are supplied in modules of such size as to eliminate the need of mechanical lifts required by the prior art to move previously designed concrete logs. When desired, the current reinforced concrete façade logs can be hued similar to the color of antique hewn wood logs.

An aspect the present method is to produce a concrete façade log that replicates the outward exterior of an antique hewn wood log including the decay associated with antique hewn wood log.

It is another aspect of the present method to produce modular sections of concrete façade log sections weighing from about 100 pounds to about 120 pounds.

Still another aspect of the present method is to produce a siding for a building that reduces the cost of property insurance in wooded areas.

Yet another aspect of the present method is to provide siding that is resistance to insect infestation and damage.

Still another aspect of the present method is to supply siding that will not shrink as the siding seasons.

It is another aspect of the present method to provide siding that rarely, if ever, requires re-chinking.

Yet another aspect of the present method is to provide reinforced concrete logs with interlocking corners.

Still another aspect of the present method is to provide interlocking corners with interlocking cast members that have an approximately six inch diameter.

An embodiment of the present method can be described as a method for providing reinforced concrete façade logs for attachment to an exterior wall of a building, said method comprising the steps of: a) supplying sections of reinforced concrete façade logs of such size and weight as to eliminate need of a mechanical lift for moving said sections, wherein the reinforced concrete façade logs further comprise pluralities of lengthwise sections and pluralities of dovetail corner sections, wherein each of the dovetail corner sections is capable of interlocking with another of the dovetail corner sections and comprises an outermost cast of greater width than a width of the cast's adjacent lengthwise section; and wherein the step of supplying sections of reinforced concrete façade logs further comprises the additional steps of: i) procuring a plurality of antique hewn wood logs, formerly a part of an antique log cabin, wherein the antique hewn wood logs were exposed to weather for at least one-hundred and fifty years; ii) creating flexible molds by using one or more of the plurality of antique hewn wood logs as forms for the flexible molds; iii) inserting a preselected molding block into at least one of the flexible molds, wherein the preselected molding block causes molding of the dovetail corner section of at least some of the reinforced concrete façade logs; or causing at least one of the created flexible molds to have a first molded end for molding the dovetail corner section of at least some of the reinforced concrete façade logs; iv) placing reinforcing means into the flexible molds; v) pouring the concrete and allowing the concrete to cure, such that after removal from the flexible molds, the cured reinforced concrete façade logs have outwardly exposed surfaces resembling the antique hewn wood logs including decay associated said antique hewn wood logs, wherein the cured reinforced concrete façade logs are segregated into modular lengthwise sections and modular dovetail corner sections; b) attaching at least some of the modular lengthwise sections to at least part of a frame of the building, wherein each of the modular lengthwise sections is generally horizontal; c) extending horizontally one of the modular dovetail corner sections from a corresponding one of the modular lengthwise sections; d) interlocking adjacent modular dovetail corners to create a corner; and e) optionally, filling in any chink with materials acceptable in the art; and f) optionally, staining the modular sections to be hued similar to the plurality of antique hewn wood logs.

Another embodiment of the present method can be described as a method for making reinforced concrete façade logs, the method comprising the steps of: a) procuring a plurality of antique hewn wood logs, formerly a part of an antique log cabin, wherein the antique hewn wood logs were exposed to weather for at least one-hundred years; b) creating flexible molds by using one or more of the plurality of antique hewn wood logs as forms for the flexible molds, wherein the flexible molds are sized to form the reinforced concrete façade logs of such weight and size as to eliminate need of a mechanical lift for moving the reinforced concrete façade logs; c) inserting a preselected molding block into at least one of the flexible molds, wherein the preselected molding block causes molding of a dovetail corner section of at least some of the reinforced concrete façade logs; or causing at least one of the created flexible molds to have a first molded end for molding the dovetail corner section of at least some of the reinforced concrete façade logs; d) placing reinforcing means into the flexible molds; e) pouring the concrete and allowing the concrete to cure, such that after removal from the flexible molds, the cured reinforced concrete façade logs have outwardly exposed surfaces resembling the antique hewn wood logs including decay associated the antique hewn wood logs, wherein the cured reinforced concrete façade logs are segregated into lengthwise sections and the dovetail corner sections such that each of the dovetail corner sections, capable of interlocking with another of the dovetail corner sections, further comprises an outermost cast of greater width than a width of the cast's adjacent lengthwise section; and f) optionally, staining the cured reinforced concrete façade logs to be hued similar to the plurality of antique hewn wood logs.

Another embodiment of the present invention can be described as a low maintenance siding for a cabin; the low maintenance siding comprising: a) a first vertical span of a plurality of generally horizontal modular lengthwise sections; b) a first set of modular corner sections extending generally horizontally and corresponding to an adjacent one of the generally horizontal modular lengthwise sections; c) a second vertical span of a plurality of generally horizontal modular lengthwise sections; d) a second set of modular corner sections extending generally horizontally and corresponding to an adjacent one of the generally horizontal modular lengthwise sections, wherein: i) the modular corner sections are interlocked to create a corner for the cabin; ii) one or more of the modular corner sections comprise an outermost cast of greater width than a width of the cast's adjacent generally horizontal modular lengthwise section; and iii) the generally horizontal modular lengthwise sections and the modular sections are of such size and weight as to eliminate need of a mechanical lift for moving the sections; and wherein e) the generally horizontal modular lengthwise sections and the modular corner sections comprise molded and cured reinforced concrete, wherein the molded and cured reinforced concrete is created by one or more molds formed from antique hewn wood logs, formerly a part of an antique log cabin, exposed to weather for at least one-hundred years such that the molded and cured reinforced concrete reproduces exterior surfaces of the antique hewn wood logs including decay associated therewith.

It is the novel and unique interaction of these simple elements which creates the methods, within the ambit of the present invention. Pursuant to Title 35 of the United States Code, descriptions of preferred embodiments follow. However, it is to be understood that the best mode descriptions do not limit the scope of the present invention.

DESCRIPTION OF THE PREFERRED EMBODIMENTS

Although the disclosure hereof is detailed to enable those skilled in the art to practice the invention, the embodiments published herein merely exemplify the present invention.

Figure 1:
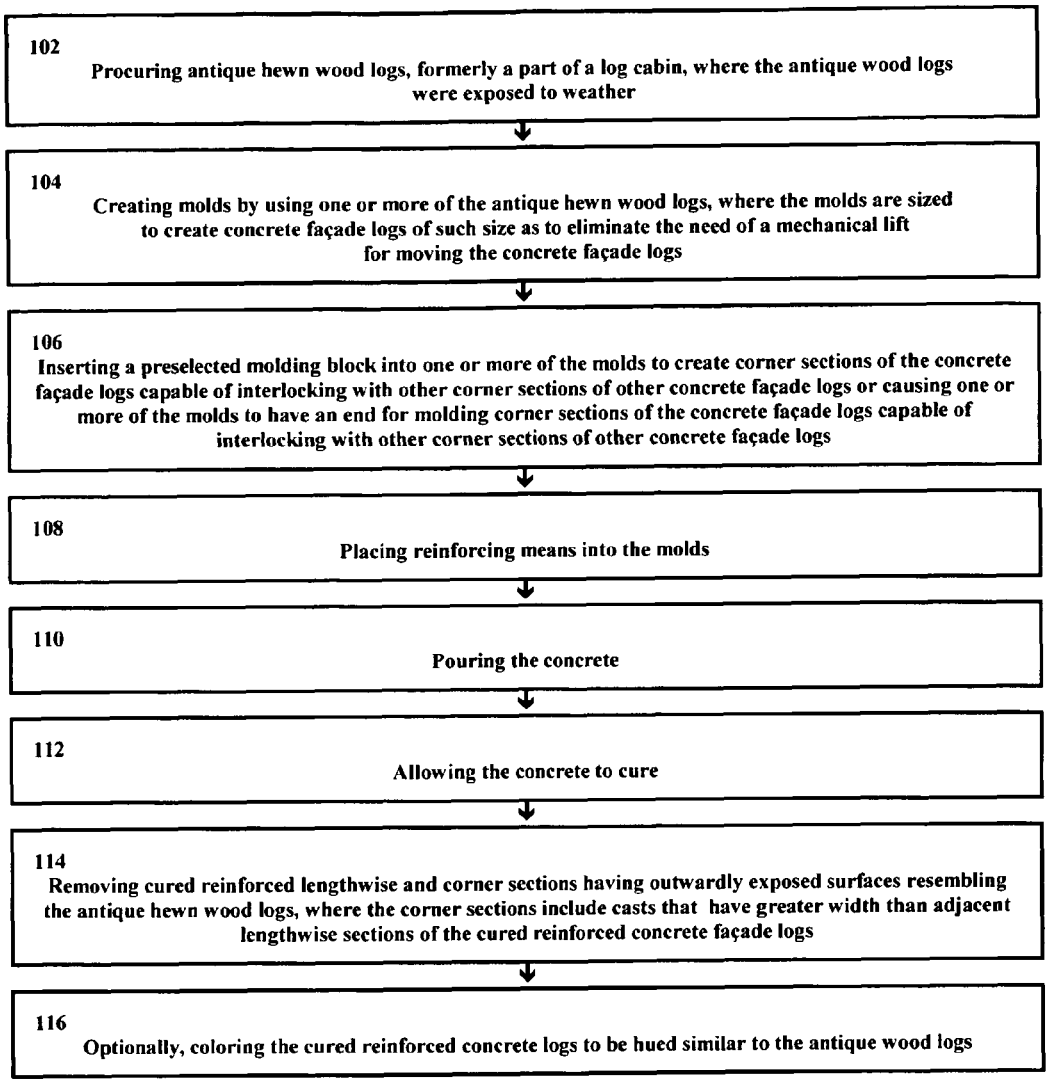
FIG. 1 portrays a preferred embodiment of the present method of making reinforced concrete façade logs

FIG. 1 portrays a preferred embodiment of the present method of making reinforced concrete façade logs. In step 102, antique hewn wood logs, formerly a part of a log cabin, are procured. In accordance with the present method, it is preferred that the antique hewn wood logs have been exposed to the weather for at least one hundred years, more preferably one hundred and fifty years, and most preferably two hundred years or more. Along with normal decay attributed to weather, the antique hewn wood logs were also subjected to natural cycle interactions with animal and/or plant life.

In step 104, molds are formed from the antique hewn wood logs, where the molds capture the exposed surfaces of the antique wooden logs including decay associated with the natural aging process of the antique wooden logs. Although other compositions can be used to create molds, within the scope of the current method, it was discovered that latex rubber molds are preferred compositions for the molds. The antique wooden logs are utilized to form one or more molds for making lengthwise sections of concrete façade logs and one or more corner sections of concrete façade logs. In accordance with select preferred embodiments of the current method, the molds create sections of concrete façade logs with an outward surface replicating the outward surface of the antique hewn wood logs used to form the molds while the inward surface of the sections of concrete façade logs are relatively smooth, i.e. generally planar concrete surfaces, but the inward surfaces can include projections or depressions to assist with the mounting of the sections to the frame of a building. The molds produce concrete façade logs of such dimensions and weight as to eliminate the need of a mechanical lift to move the concrete façade logs as required by the prior art. By way of illustration, concrete façade logs, within the scope of the current method, weigh from about 100 pounds to about 120 pounds. For select preferred embodiments of the lengthwise sections, the lengthwise sections can have a length of up to about eight feet, an outward exposed surface's height of from about ten inches to about twelve inches and a width of from about 1 inch to about two inches.

In step 106, molds for the interlocking corner sections can be formed by creating a mold that includes a specialized molding at one end thereof for making an interlocking corner cast, or in the alternative, a preselected specialized molding block can be added to a lengthwise mold for molding an interlocking corner cast. For select preferred embodiments of the interlocking corner sections, the interlocking corner section has a surface for aligning with the outward exposed plane of the lengthwise section of similar dimensions to the lengthwise section as a first part and an interlocking cast member with an approximately six inch diameter as a second part. Thus, the corner cast of the interlocking corner section is wider than the width of the lengthwise section and is capable of creating the three dimensional impression that a wooden log of an approximate six inch diameter was used to build the cabin. Although different types of interlocking corners are within the scope of the present method, it has been discovered that dovetail interlocking corners are preferred. As with the lengthwise sections molds, molds for the interlocking corners result in concrete façade log corners of such dimensions and weight as to eliminate the need of a mechanical lift to move the interlocking corners. By way of illustration, concrete façade log corners, within the scope of the current method, weigh from about 100 pounds to about 120 pounds.

In step 108, any reinforcing means acceptable in the art is placed into the molds for reinforcing the concrete.

In step 110, the concrete is poured into the molds.

In step 112, the concrete is cured.

In step 114, the molds are removed from the cured reinforced concrete resulting in modular lengthwise and modular interlocking corner sections of such size and weight that the modules are movable without the need of a mechanical lift.

In accordance with the present method, step 116 is optional. In step 116, the cured reinforced concrete logs are colored to a hue similar to the antique wooden logs used to form the molds for the modular lengthwise and modular interlocking corner sections of the cured reinforced concrete logs. Coloring of the cured reinforced concrete façade logs can be accomplished with chemicals such as paints or stains.

Figure 2:
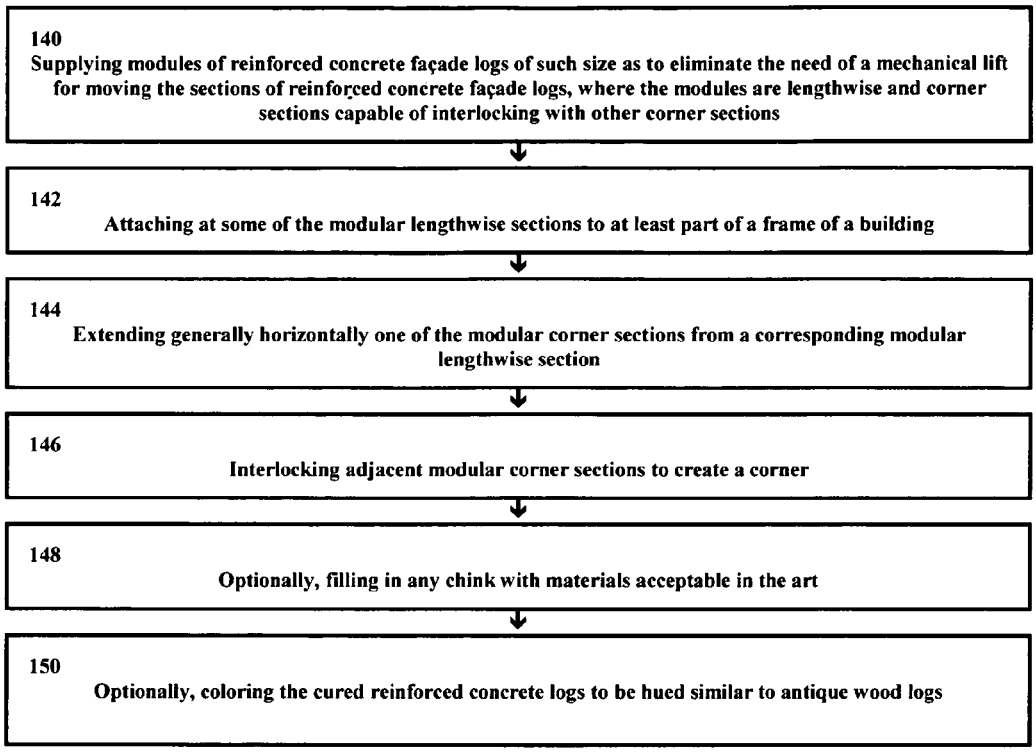
FIG. 2 illustrates a preferred embodiment of providing reinforced concrete façade logs for attachment to an exterior wall of a building.

FIG. 2 illustrates a preferred embodiment of providing reinforced concrete façade logs for attachment to an exterior wall of a building. In step 140, lengthwise modules and corner modules of reinforced concrete façade logs, of such size as to eliminate the need of a mechanical lift for moving the modules, are supplied. The lengthwise modular section and corner modular sections are manufactured in accordance with processes enabled in steps 102 through 114.

In step 142, some of the lengthwise modular sections are attached to the frame of a building.

In step 144, modular corner sections are extended generally horizontally from the corresponding lengthwise modular section.

In step 146, adjacent modular corner sections are interlocked to create a corner.

In accordance with the present method, steps 148 and 150 are optional. In optional step 148, chinks are filled in with any material acceptable in the art, such as concrete. And in optional step 150, the modular sections are colored to a hue similar to the antique wooden logs used to form the molds for the modular lengthwise and modular interlocking corner sections of the cured reinforced concrete logs. The coloring of the cured reinforced concrete façade logs can be accomplished with chemicals such as paints or stains.

Figure 3:
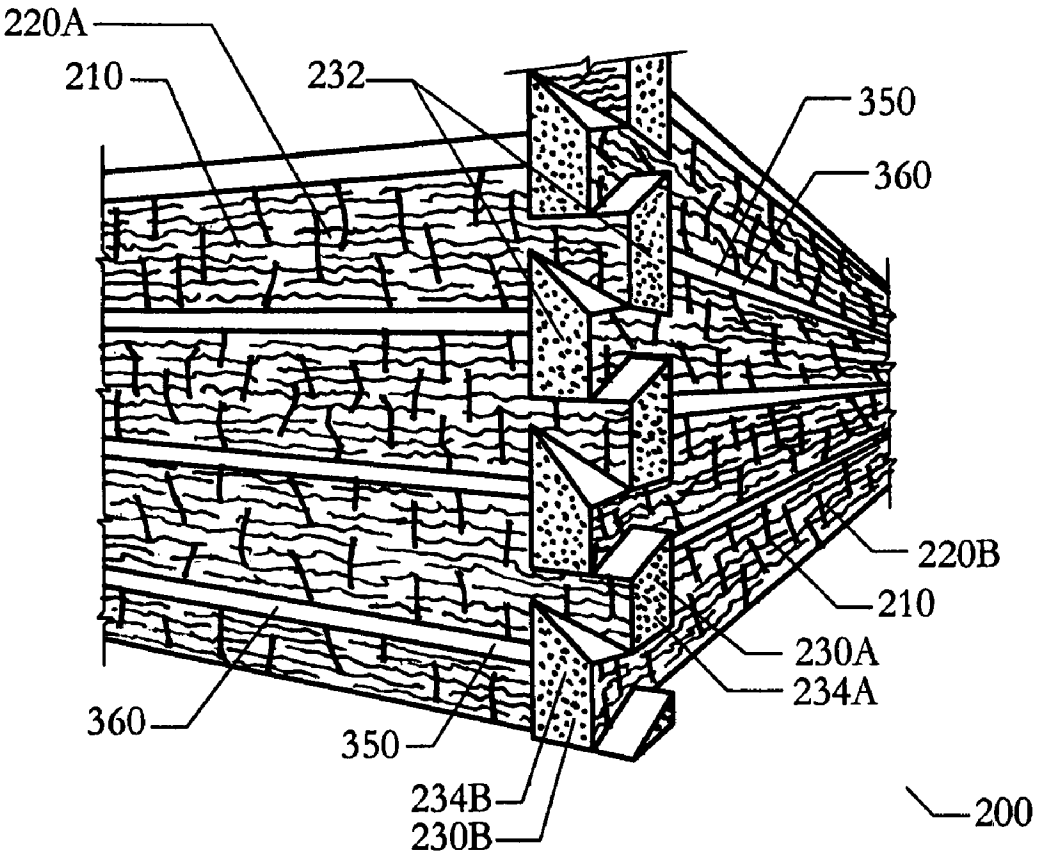
FIG. 3 is an isometric view of two intersecting sides of building (200) with walls utilizing the low maintenance siding of the present invention.

FIG. 3 is an isometric view of two intersecting sides of building (200) with walls utilizing the low maintenance siding of the present invention. As shown in FIG. 3, low maintenance siding has a first span of generally horizontal modular lengthwise sections (220A) of cured reinforced concrete façade logs (210) manufactured in accordance with the processes of steps 102 through 116 disclosed above. Second span of generally horizontal modular lengthwise sections (220B) of concrete façade logs (210) are also manufactured in accordance with the processes of steps 102 through 116 previously enabled. Modular dovetail corner sections (230A) abut and are situated generally horizontally from each of generally horizontal modular lengthwise sections (220A). The modular dovetail corner sections (230B) are connected with and are positioned generally horizontally from each of generally horizontal modular lengthwise sections (220B). Interlocking of dovetail corner sections (230A and 230B) create corners (232). Modular dovetail corners (230A and 230B) have outermost casts (234A and 234B). Each outermost cast (234A) has a greater width than the adjacent modular lengthwise section (220A) and each outermost cast (234B) has a greater width than the adjacent modular lengthwise section (220B). Modular dovetail corner sections (230A and 230B) are manufactured in accordance with the processes of steps 102 through 116 set forth above.

Figure 4:
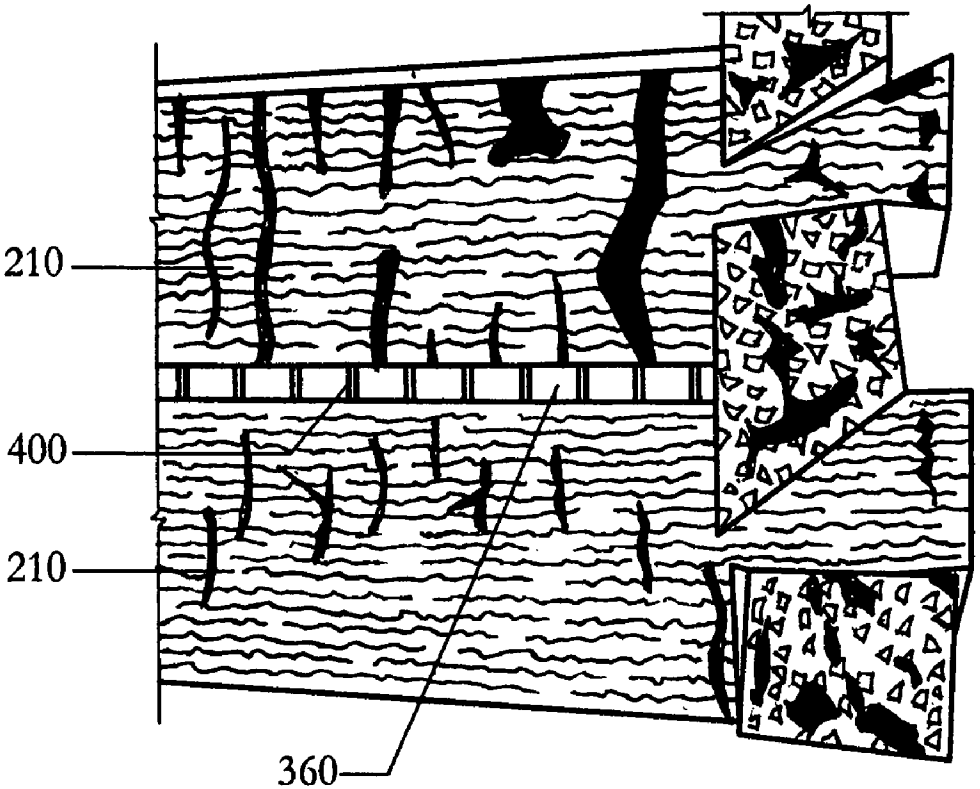
FIG. 4 is a frontal perspective of embodiments of cured reinforced concrete façade logs.

As shown in FIG. 3, chinks (360) have been filled in with concrete (350). FIG. 4 is a frontal perspective of preferred embodiments of cured reinforced concrete façade logs (210). In FIG. 4, chinks (360) have not been closed and wires (400) associated with a frame supporting cured reinforced concrete façade logs (210) are visible.

Figure 5:
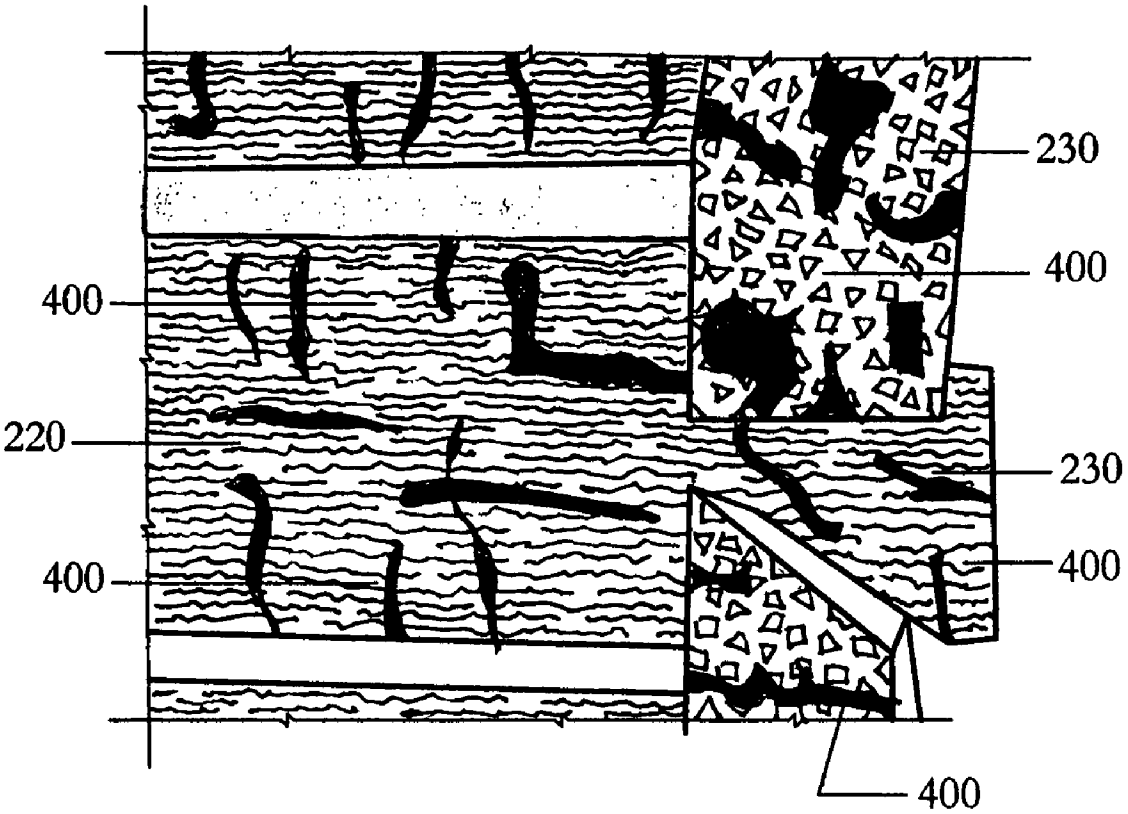
FIG. 5 is a close-up perspective of an embodiment of a modular lengthwise section portraying the decay associated with the antique hewn wooden logs.

FIG. 5 is a close-up perspective of a modular lengthwise section (220) and interlocked modular dovetail corner sections (230) where the decay (400), associated with the antique hewn wooden logs of steps 102 through 116, is replicated.

Figure 6:
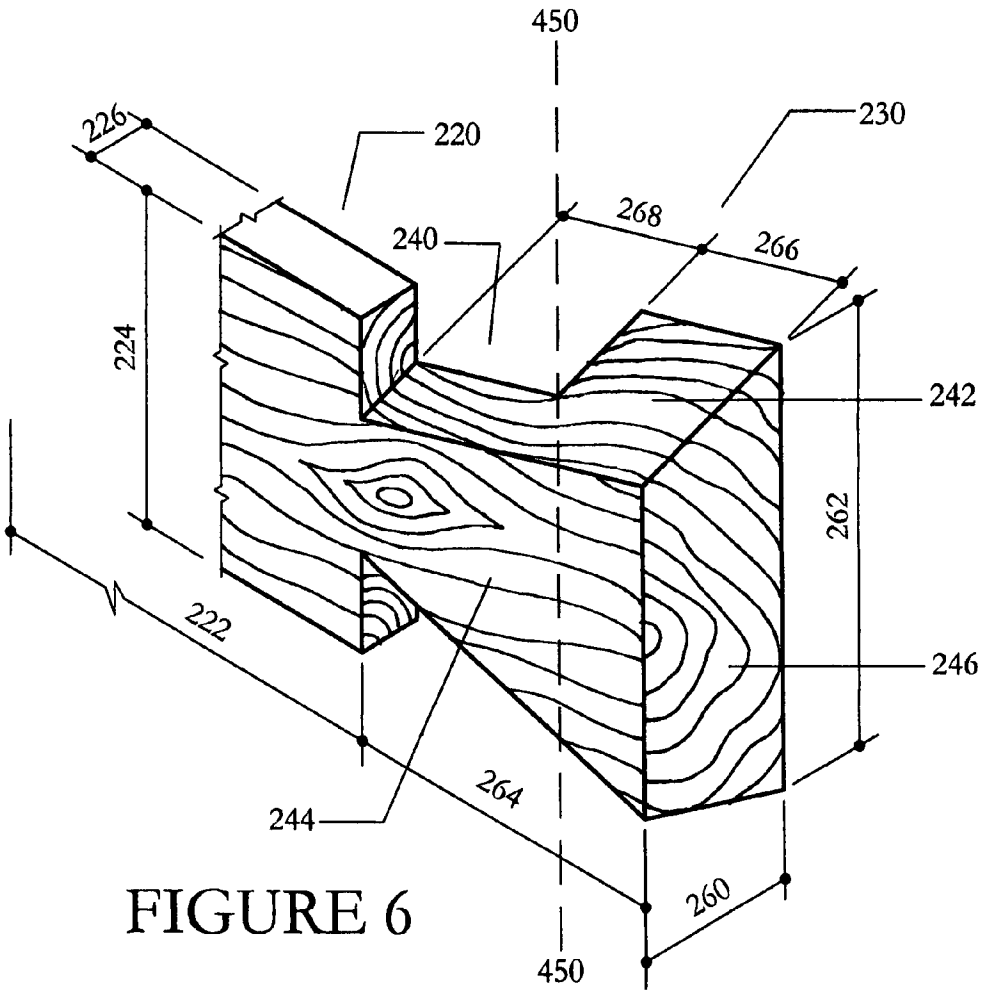
FIG. 6 is a perspective of an embodiment of a modular corner section abutting a modular lengthwise section of the current invention.

FIG. 6 is a perspective of a preferred embodiment of modular corner section (230) abutting a preferred embodiment of modular lengthwise section (220) of the current invention. Broken line 450-450 symbolizes a corner of the building that is created by interlocking corner sections (230). As previously indicated, preferred embodiments of modular lengthwise sections (220) can have lengths (222) of up to about eight feet, outward exposed planes' heights (224) of from about ten inches to about twelve inches and widths (226) of from about 1 inch to about two inches. As shown in FIG. 6, a preferred embodiment of modular corner section (230) has interlocking space (240), interlocking member (242), tapering side (244) and outermost cast (246). As indicated by the numerically referenced elements, select measurements of preferred embodiments of modular corner sections (230) are: (260) from about five inches to about six inches; (262) from about ten inches to about twelve inches; (264) from about eight inches to about twelve inches; (266) from about four inches to about seven inches; and (268) from about four inches to about five inches. Outermost cast (246) has a width greater than twice the width of modular dovetail corner section's (230) adjacent generally horizontal modular lengthwise section (220) and gives the visual impression that modular dovetail corner section (230) is hewn from an antique wood log of a diameter greater than twelve inches.

Having disclosed the invention as required by Title 35 of the United States Code, Applicant now prays respectfully that Letters Patent be granted for his invention in accordance with the scope of the claims appended hereto.

What is claimed is:

1. A method for providing reinforced concrete façade logs for attachment to an exterior wall of a building, said method comprising the steps of:

a) supplying sections of reinforced concrete façade logs of such size and weight as to eliminate need of a mechanical lift for moving said sections, wherein said reinforced concrete façade logs further comprise pluralities of lengthwise sections and pluralities of dovetail corner sections, wherein each of said dovetail corner sections is capable of interlocking with another of said dovetail corner sections and comprises an outermost cast of greater width than a width of said cast's adjacent lengthwise section; and wherein said step of supplying sections of reinforced concrete façade logs further comprises the additional steps of:

i) procuring a plurality of antique hewn wood logs, formerly a part of an antique log cabin, wherein said antique hewn wood logs were exposed to weather for at least one-hundred and fifty years;

ii) creating flexible molds by using one or more of said plurality of antique hewn wood logs as forms for said flexible molds;

iii) inserting a preselected molding block into at least one of said flexible molds, wherein said preselected molding block causes molding of said dovetail corner section of at least some of said reinforced concrete façade logs; or causing at least one of said created flexible molds to have a first molded end for molding said dovetail corner section of at least some of said reinforced concrete façade logs;

iv) placing reinforcing means into said flexible molds;

v) pouring said concrete and allowing said concrete to cure, such that after removal from said flexible molds, said cured reinforced concrete façade logs have outwardly exposed surfaces resembling said antique hewn wood logs including decay associated said antique hewn wood logs, wherein said cured reinforced concrete façade logs are segregated into modular lengthwise sections and modular dovetail corner sections;

b) attaching at least some of said modular lengthwise sections to at least part of a frame of said building, wherein each of said modular lengthwise sections is generally horizontal;

c) extending horizontally one of said modular dovetail corner sections from a corresponding one of said modular lengthwise sections;

d) interlocking adjacent modular dovetail corners to create a corner; and e) optionally, filling in any chink with materials acceptable in the art; and f) optionally, staining said modular sections to be hued similar to said plurality of antique hewn wood logs.

2. The method of claim 1, wherein the step of supplying sections of reinforced concrete façade logs supplies said modular lengthwise sections and said modular dovetail corner sections weighing less than about one-hundred and twenty pounds.

3. The method of claim 2, wherein the step of supplying sections of reinforced concrete façade logs further comprises the step of creating said flexible mold to mold one or more projections or depressions on one or more inward surfaces of said reinforced concrete façade logs.

4. The method of claim 3 wherein said modular lengthwise sections and said modular dovetail corner sections weigh from about one-hundred to about one-hundred and twenty pounds.

5. The method of claim 4, wherein the step of supplying modular dovetail corner sections supplies said modular dovetail corner sections with said outermost casts greater than twice said width of each of said cast's adjacent lengthwise section for giving a visual impression that each said modular dovetail corner section is hewn from an antique wood log comprising a diameter greater than twelve inches.

6. A method for making reinforced concrete façade logs, said method comprising the steps of:

a) procuring a plurality of antique hewn wood logs, formerly a part of an antique log cabin, wherein said antique hewn wood logs were exposed to weather for at least one-hundred years;

b) creating flexible molds by using one or more of said plurality of antique hewn wood logs as forms for said flexible molds, wherein said flexible molds are sized to form said reinforced concrete façade logs of such weight and size as to eliminate need of a mechanical lift for moving said reinforced concrete façade logs;

c) inserting a preselected molding block into at least one of said flexible molds, wherein said preselected molding block causes molding of a dovetail corner section of at least some of said reinforced concrete façade logs; or causing at least one of said created flexible molds to have a first molded end for molding said dovetail corner section of at least some of said reinforced concrete façade logs;

d) placing reinforcing means into said flexible molds;

e) pouring said concrete and allowing said concrete to cure, such that after removal from said flexible molds, said cured reinforced concrete façade logs have outwardly exposed surfaces resembling said antique hewn wood logs including decay associated said antique hewn wood logs, wherein said cured reinforced concrete façade logs are segregated into lengthwise sections and said dovetail corner sections such that each of said dovetail corner sections, capable of interlocking with another of said dovetail corner sections, further comprises an outermost cast of greater width than a width of said cast's adjacent lengthwise section; and f) optionally, staining said cured reinforced concrete façade logs to be hued similar to said plurality of antique hewn wood logs.

7. The method of claim 6, wherein said step of creating flexible molds by using one or more of said plurality of antique hewn wood logs molds said reinforced concrete façade logs weighing less than about hundred and twenty pounds.

8. The method of claim 7, wherein said step of procuring a plurality of antique hewn wood logs comprises procuring said antique hewn wood logs exposed to weather for at least one-hundred and fifty hundred years.

9. The method of claim 8, wherein the step of creating flexible molds by using one or more of said plurality of antique hewn wood logs as forms for said flexible molds for molding one or more projections or depressions on one or more inward surfaces of said reinforced concrete façade logs.

10. The method of claim 9 wherein said reinforced concrete façade logs weigh from about one hundred to about one hundred and twenty pounds.

11. The method of claim 10, wherein said step of procuring a plurality of antique hewn wood logs comprises procuring said antique hewn wood logs exposed to weather for at least two-hundred years.

12. The method of claim 11, wherein the step of pouring said concrete and allowing said concrete to cure creates said dovetail corner sections with said outermost casts greater than twice said width of each of said cast's adjacent lengthwise section for giving a visual impression that each said modular dovetail corner section is hewn from an antique wood log comprising a diameter greater than twelve inches.

* * * * *